US005421224A

United States Patent [19]

Bond

[11] Patent Number: 5,421,224

[45] **Date of Patent: * Jun. 6, 1995**

[54] HEAD INDICIA TO INDICATE TOOL TYPE

[75] Inventor: David Bond, Phoenix, Ariz.

[73] Assignee: Klein Tools, Chicago, Ill.

[ * ] Notice: The portion of the term of this patent subsequent to Aug. 30, 2011 has been disclaimed.

[21] Appl. No.: 271,781

[22] Filed: Jul. 7, 1994

Related U.S. Application Data

[63] Continuation of Ser. No. 902,839, Jun. 23, 1992, Pat. No. 5,341,707.

[51] Int. Cl.[6] ..... B25B 15/02

[52] U.S. Cl. ..... 81/436; 81/DIG. 5

[58] Field of Search ..... 81/436, 121.1, 177.1, 81/427.5, DIG. 5

[56] References Cited

U.S. PATENT DOCUMENTS

D. 312,033 11/1990 Carlson .
1,984,839 12/1934 Murray .
2,202,253 5/1940 Hiatt .
4,671,916 6/1987 Hamas .
4,841,653 6/1989 Negley .

OTHER PUBLICATIONS

Jensen Tools and Alloys, Jensen Fall Catalog 1977, "Hollow-Shaft Nutdrivers", p. 104, 1977, fall.

*Primary Examiner*—D. S. Meislin
*Attorney, Agent, or Firm*—Welsh & Katz, Ltd.

[57] ABSTRACT

Head indicia to indicate tool type which is integrally formed on the handle portion of the tool. The indicia is a symbol which emulates the configuration of the tool head and which indicates the orientation of the tool head. The indicia can be recessed into or raised from the surface of the handle to provide tactile identity of the configuration and orientation of the tool head. The indicia provides the user with an efficient way to select the correct tool and tool head type from a group of tools or from a set of tools held in a tool belt or pouch.

1 Claim, 1 Drawing Sheet

HEAD INDICIA TO INDICATE TOOL TYPE

This is a continuation of application Ser. No. 902,839, filed Jun. 23, 1992, now U.S. Pat. No. 5,341,707.

The present invention relates generally to an indicia for hand-held tools which emulates the tool type for indicating to the user the tool type without having to view the working end of the tool.

BACKGROUND OF THE INVENTION

Hand-held tools come in a seemingly endless array of configurations for use in industrial, electronic, automotive, construction and household applications. Tools used to drive fasteners, such as screwdrivers, tapping tools, awls, nutdrivers and the like, not only come in different sizes and dimensions, but are typically configured with a variety of head or bit types. Currently known and commonly used standard tool head or bit types include: flat, phillips, clutch, hex, Reed & Prince, square, Pozidriv ® and Torx ®. Flathead drivers, commonly used on screwdrivers, are further divided into cabinet, keystone or slotted configurations. Obviously, there are numerous combinations of tool and tool head types when one takes into consideration the variety of tools together with all of the possible tool head configurations that are currently available. Further, the number of such combinations increases when one considers that new tool and head types are commonly developed for new applications.

For the individual who uses only one or two tools at a time, and then only periodically, there is no great difficulty in simply looking at the tool and its working end to determine if it is the appropriate tool for the project. However, for those who use a variety of tools on a more consistent basis, the endless array of tools and head types to choose from can become a frustrating and time consuming chore, which detracts from the individual's concentration and desire to complete the project properly. Electricians, contractors, mechanics and other artisans who use tools on a consistent, day-to-day basis, can waste considerable time simply attempting to pick the right tool type, while repeatedly discovering that the head type is wrong.

The problem is compounded when the project requires the artisan to grasp or hold the item or components of the item being worked on with one hand, while attempting to find the correct tool with the proper head type using the free hand. Similarly, when working on projects that require intense concentration or involve intricate assemblies and precision workmanship, the time and effort that it takes to select the appropriate tool and head type may result in a less than satisfactory job. Further, the movements involved in searching through tools and having to examine their working end may cause the artisan to loose his grip of the item or inadvertently move or misalign the assembly being worked on.

Often, artisans will attempt to minimize the difficulties of selecting the proper tool by utilizing a tool belt or tool pouch, which typically holds a number of tools around the artisan's waist. Usually, the artisan will load the tool belt or pouch with those tools that they predict will be required for the project. The artisan may arrange the tools in a predetermined sequence to aid in the selection process during the project, or as is more common, will simply load the tool belt or pouch as the tools are selected. Although the use of a tool belt cuts down on the number of tools that must be reviewed before making a selection, it is still common that the wrong tool is chosen. Obviously, if the tools held in the tool belt or pouch are all of the same type, such as screwdrivers, then it is not difficult to understand how the wrong head type or head size could be selected.

Additionally, because artisans may be working in areas with little or no light, the selections of the proper tool must be made by touching the working end of the tools. This also wastes time and becomes increasingly frustrating, especially if many tools must be used during the project. Again, because the artisan's other hand may be used to hold or grasp the item being worked on, it is extremely difficult to grasp, twist or turn and feel for the working end of the tools until the proper one is selected.

Finally, once the proper tool and head type is selected, it may be difficult to visualize the orientation of the tool head so as to align it with the face of the item being driven by the tool. If not aligned, the tool will not drive the item properly, which may cause the item or the tool to be damaged. For example, a phillips head screwdriver may not be aligned correctly with the receiving screw, and when torque is applied to the screwdriver the screwdriver may slip, thereby stripping the screw and possible damaging the screwdriver head itself. The problem is more common when using a typical flathead screwdriver since the flat head configuration of the screwdriver must slide into and fit within the receiving cavity or channel on the face of the fastener.

Thus, there is a need for providing indicia on tools, which will visually and tactilely indicate to the user the head type. Further, there is a need for providing tools, such as screwdrivers, nutdrivers, awls and the like, with indicia which indicate the configuration of the working end or tool head, the orientation of the tool head and, optionally, the dimension of the tool head.

Accordingly, it is an object of the present invention to provide indicia for tools, which will indicate to the user by sight or touch the configuration of the tool without having to view the working end of the tool.

It is a further object of the present invention to provide indicia for tools, which indicates the configuration of the tool and the orientation of the working end of the tool.

It is yet a further object of the present invention to provide indicia for tools, which will indicate the configuration of the tool by sight or touch without having to handle the working end of the tool.

In accordance with the present invention, all of these objects, as well as other not herein specifically identified, are achieved generally by the present indicia for indicating tool type. Broadly stated, the present invention consists of a hand held tool of the type having a working end and a handle end. The tool has a handle adapted with a tool receiving end and a butt end. The handle is configured for easy grasping by the user. The tool has a tool head adapted to the working end of the tool configured and arranged for engaging a fastener. A symbol is integrally formed on the handle, the symbol is configured to emulate and provide an accurate manifestation of the tool head. The symbol may be recessed into the handle or raised slightly above the surface of the handle.

BRIEF DESCRIPTION OF THE DRAWINGS

Other features and advantages of the present head indicia to indicate tool type will become apparent to those skilled in the art upon review of the following detailed description, claims and drawings, in which:

DETAILED DESCRIPTION OF THE INVENTION

Figure 1:
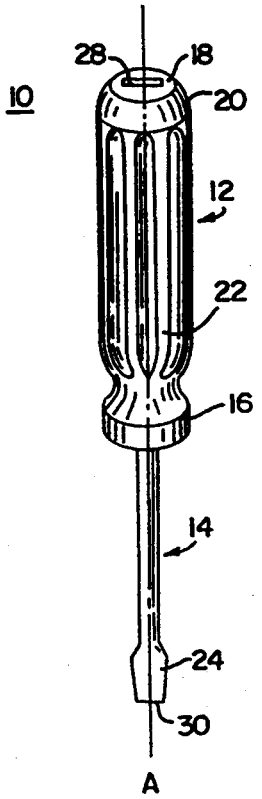
FIG. 1 is a perspective view of the present head indicia showing a common flat head screwdriver with the indicia emulating the configuration and orientation of the working end.

Referring now more particularly to the drawings, shown in FIGS. 1–7 are the preferred embodiments of the present invention. Shown most clearly in FIGS. 1 and 2, a typical handtool, shown here as a screwdriver 10, includes a handle 12 and a working end 14. The handle 12 has a tool end 16 and a butt 18. The butt 18 provides a face on said handle which is substantially perpendicular to a vertical axis, designated as A, of the tool or screwdriver 10. The butt 18 of most handtools is flat, but may include beveled or rounded sides 20. To provide a grasping surface, the handle 12 of most handtools will also have grooves or ridges 22. The working end 14 has at its lower most end, opposite to handle 12, a tool head 24. As shown, the screwdriver 10 has a standard flathead configuration in FIG. 1 and a phillips head in FIG. 2. However, numerous other types of tool head configurations are possible. The handle 16, butt 18 and tool head 24 are centrally located along the vertical axis A, of the screwdriver 10.

Figure 2:
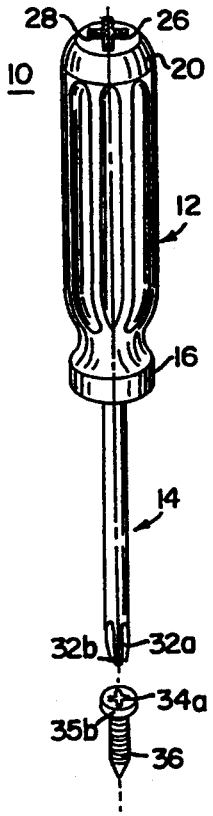
FIG. 2 is a perspective view of the present head indicia showing a phillips head on a raised indicia.
Figure 3:
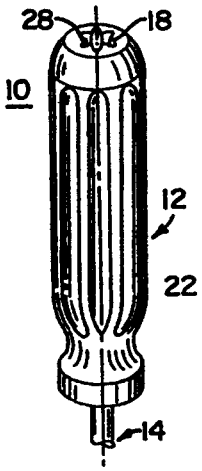
FIG. 3 is a perspective view of the present invention showing a Torx® configuration.
Figure 4:
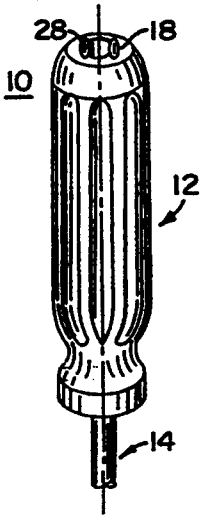
FIG. 4 is a perspective view of the present invention showing a clutch configuration.
Figure 5:
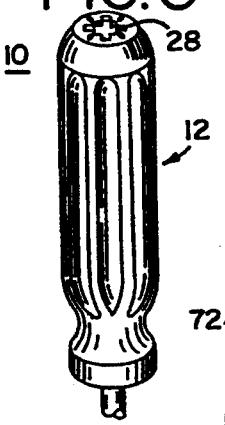
FIG. 5 is a perspective view of the present invention showing a Pozidriv® configuration.

To indicate to the user of the screwdriver 10 the specific configuration of the tool head 24, a symbol, indicator or head indicia 28 is located on the handle 16 or butt 18. Indicia 28 emulates and provides a manifestation of the type of tool head 24. In FIG. 1, the indicia 28 is a symbol that depicts the flat head configuration of the tool head 24 of screwdriver 10. As shown in FIG. 1, the indicia 28 is integrally formed and cut into or recessed into the surface of butt 18. Alternatively, as shown in FIG. 2, the indicia 28 may be integrally formed and raised from the surface of the butt 18. The indicia 28 can also be formed on the butt 18 so as to be flush with the surface of the handle 12, although this arrangement does not provide the preferred type tool indication of the type.

While not specifically illustrated, the present head indicia 28 can be utilized on other types of tools such as pliers, hammers, wrenches and the like without departing from the scope of the present invention disclosed herein. Additionally, for purposes of illustration only and not as a limitation, the several figures depict other standard tool head configurations that may utilize the present head indicia 28 to simplify tool selection. These head types include, inter alia, phillips or frearson (FIG. 2), Torx® (FIG. 3), clutch (FIG. 4), square (FIG. 6), and hex (FIG. 7).

Throughout the several views, it is shown how the indicia 28 is arranged on the butt 18 or handle 12 of the tools to emulate the configuration of tool head 24. Although not required, the indicia 28 can also emulate the true orientation of the tool head 24 so as to provide the user with a way to align the tool head 24 with the fastener being driven by the tool 10. If the tool head 24 does not line up or mate properly with the corresponding fastener, the tool head 24 may slip and strip the fastener or tool head 24 when torque is applied to the tool 10. Using the present indicia 28, the user simply views the orientation of the face or receiving end of the fastener and positions the tool 10 so that the orientation of the indicia 28 matches the orientation of the fastener before torque is applied to drive the fastener.

More specifically, the indicia 28 on butt 18 lines up directly with the flat head edge 30 of the tool head 24 along the vertical axis A of the screwdriver 10. FIG. 2 shows another illustration of how the indicia 28 indicates the orientation of the tool head 24. As shown, the indicia 28 depicts the exact orientation of the several edges 32*a* and 32*b* that comprise a typical phillips head so that the user can correctly hold the screwdriver 10 to align the tool head 28 and match the channels 34*a* and 34*b* of the fastener 36.

In FIGS. 1 and 2, a typical screwdriver is used to demonstrate the present head indicia 28, but it should be understood that other tools such as tapping tools, awls, nutdrivers, pliers, wrenches, and the like can use the present head indicia 28 without departing from the nature or scope of the present invention. Essentially, any tool which incorporates a head configuration that can be emulated by a symbol, character or other form of indicia can utilize the present head indicia 28.

Figure 6:
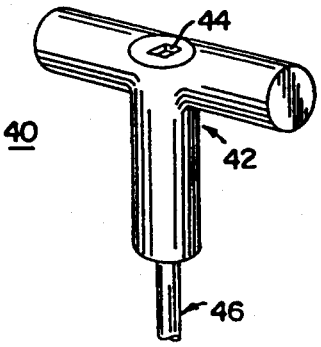
FIG. 6 is a perspective view of the present head indicia on a T-type tool handle.
Figure 7:
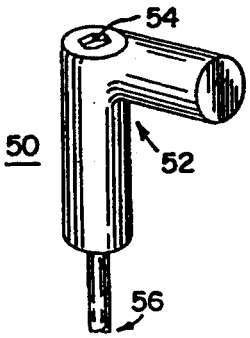
FIG. 7 is a perspective view of the present head indicia on an L-type tool handle.

Accordingly, FIGS. 6 and 7 show the present invention used on another type of handtool, namely nutdrivers 40 and 50. Shown in FIG. 6 is a T-shaped handle 42, which incorporates head indicia 44, configured here as a square to emulate the square tool head (not shown) on the working end 46 of the nutdriver 40. As in the preferred embodiment, the indicia 44 can be arranged on the handle 42 to correspond with the orientation of the square tool head. Additionally, as shown, the indicia 44 can be recessed into the handle 42 or it can be raised from the surface of the handle 42. Shown in FIG. 7 is another nutdriver 50 having an L-shaped handle 52. The nutdriver 50 incorporates head indicia 44, configured here as a hex to emulate the hex tool head (not shown) on the working end 46 of the nutdriver 50.

Figure 8:
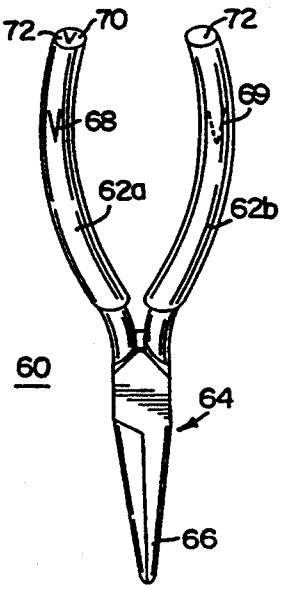
FIG. 8 is a perspective view of the present head indicia used on a pair of pliers.

Further, to demonstrate that the present head indicia 28 can be utilized with tools other than handtools designed primarily for driving fasteners. As shown in FIG. 8, ordinary pliers 60 typically include a pair of handles or grips 62*a* and 62*b* and a working end 64. The working end 64 is configured with a clasping or cutting jaw 66. In this embodiment of the present invention, the indicia 68 illustrating the type of working end, or configuration of jaw 66 is located on grip 62*a*. If the indicia 68 is located in grip 62*a*, then it is preferred that the indicia 69, which is identical to indicia 68, be located on the opposing side of grip 62*b*. Indicia 68 and 69 are provided so that the user can determine the tool head type upon grasping the pliers 60 along either side. Alternatively, an indicia 70 can be formed on a blunt end 72 of either grip 62*a* or 62*b* in the same manner as with screwdriver 10 or nutdrivers 40 and 50.

To provide tactile indication of the tool head configuration, the present head indicia 28 can be integrally formed and recessed or cut into butt 18 as shown in the preferred embodiment of FIG. 1. Alternatively, the head indicia 28 can be integrally formed and raised above the surface of butt 18 as shown in FIG. 2. Recessing or raising the indicia 28 provides the user with an indicia that can be felt by the user's fingers, as well as being visible. Handtools, such as screwdriver 10 or nutdrivers 40 and 50, are often used in working areas that are inadequately illuminated. Many times a user may actually be working in darkness. Accordingly, it is contemplated that the formation of the indicia 28, whether raised or recessed, will provide the user with a tactile indication of the tool head configuration.

It is also contemplated that the indicia 28 can be coated with paint or other marking substance to provide a more visible indicia for the user. As shown in FIG. 2, the indicia 28 depicting a phillips head configuration has been colored or coated with paint on its surface 26 so that the indicia 28 is distinct from the surface of the butt 18 or handle 12. The coating can be ordinary paint, or a florescent paint-like substance which will further increase the visibility of indicia 28 in dimly lit work areas. It is also anticipated that the indicia 28 can be painted to correspond to a color coded scheme that will indicate by color the tool type or other selected characteristic of the tool.

Also, the indicia 28 can be configured to match the dimensions of the tool head 24 so that the user can easily identify the size and/or shape of the tool head 24. For example, if the tool head 24 is configured for fastening a ⅛" fastener, the head indicia 28 will be a corresponding ⅛" manifestation of that tool head type.

It is contemplated that the indicia 28 will be integrally formed on the handle 12 during manufacturing of the handle 12 and tool 10. The indicia 28 can be machined and recessed into the handle 12, or alternatively, molded onto and raised from the handle 12. In either case, the additional cost of including the indicia 28 is relatively minor, while the marketing benefits are high. It is also anticipated that the indicia 28 can be added onto the handle 12 of previously manufactured or used tools to reconfigure the tools which were not originally manufactured with the indicia 28.

In operation, the user can quickly and easily determine the type of tool and tool head type by simply viewing or touching the indicia 28 located on the butt 18 of a tool, such as screwdriver 10. Accordingly, if a number of tools are stored together in a toolbox or the like, then the user can identify the proper tool for the project by viewing or touching the butt 18. The ability to select a proper tool with the correct head type and dimensions by touching the tool is particularly useful where there is inadequate lighting.

It is contemplated that the present head indicia 28 used on a tool, such as screwdriver 10, will be most useful when used in conjunction with a tool belt or tool pouch. A tool belt is commonly used to store a number of preselected tools around the individual's waste or hip. Typically, the butt 18 will face upwards towards the user's line of vision when stored in such a tool belt or pouch. Therefore, the present indicia 28 utilizes the properties of the tool belt or pouch to facilitate the selection of the correct tool and correct tool head type. Because the indicia is preferably located on the butt 18 or somewhere along the end of the handle 12, the user can select the correct tool and tool head by glancing down at the tools held in the belt or pouch and viewing or touching the indicia on the butt 18 of the tool. Instead of foraging through numerous tools until the correct one is selected, the user need only expend seconds to glance down at and select the right tool.

Once the proper tool has been selected, either by viewing or touching the present head indicia 28, the user can then utilize the head indicia 28 to quickly and easily engage the fastener. By providing head indicia 28 that manifests the orientation of the tool head 24, the user does not waste time or damage the tool head 24 or fastener by repeatedly turning the tool 10 until the tool head 24 matches and catches the fastener. Additionally, if the head indicia 28 depicts the actual size of the tool head 24, then the user is provided with an indication of the tool type, tool head configuration and size of the tool head, which further simplifies the selection of the proper tool.

Accordingly, the inclusion of the present head indicia 28 to indicate tool type on tools is an inexpensive, yet effective and efficient way to increase productivity by aiding in tool selection during a project. The present tool head indicia 28 gives the user the ability to select the proper tool in poorly lit or dark work sites. Further, the present head indicia 28 can be used in conjunction with a tool belt to further simplify tool selection.

While various embodiments of the present invention have been shown and described, it should be understood that various alternatives, substitutions and equivalents can be used, and the present invention should only be limited by the claims and equivalents thereof. Therefore, the terms and expressions serve only to describe the invention by example only and not to limit the invention. It is expected that others will perceive differences which, while differing for the foregoing, do not depart from the spirit and its scope of the invention herein described and claimed.

Various features of the present invention are set forth in the following claims.

What is claimed is:

1. A combination tool and tool head indicia, the combination comprising:

a tool having an upper end and a lower end, and a vertical axis through said upper end and said lower end;

said tool having a handle portion located along said upper end of said tool, said handle being centered along said vertical axis;

a butt portion presenting a face on said handle portion substantially perpendicular to said vertical axis of said tool;

a tool head located along said lower end of said tool opposite said handle portion, said tool head being centered along said vertical axis of said tool; and a symbol formed on said butt portion that represents the configuration of said tool head, so that said tool head may be identified by viewing said butt portion when hung from the belt of a user.

* * * * *